United States Patent [19]

Legille et al.

[11] 4,151,047

[45] Apr. 24, 1979

[54] FEED INSTALLATION FOR APPARATUS FOR EXTRACTING HYDROCARBONS FROM BITUMINOUS SCHISTS

[75] Inventors: Edouard Legille, Luxembourg; René Mahr, Howald-Hespérange, both of Luxembourg

[73] Assignee: S.A. des Anciens Etablissements Paul Wurth, Luxembourg, Luxembourg

[21] Appl. No.: 822,345

[22] Filed: Aug. 5, 1977

[30] Foreign Application Priority Data

Aug. 13, 1976 [LU] Luxembourg ..... 75590

[51] Int. Cl.[2] ..... B66C 17/08; C10B 31/02

[52] U.S. Cl. ..... 202/262; 201/40; 202/269; 414/161; 414/163; 414/195

[58] Field of Search ..... 202/269, 262; 201/40; 214/17 B, 18 V, 18.24, 18.22, 18.2, 18.3, 18.38, 17 CA, 35 R

[56] References Cited

U.S. PATENT DOCUMENTS

| | | | |
|---|---|---|---|
| 1,376,567 | 5/1921 | Nielsen et al. | 214/18 V |
| 1,999,895 | 4/1935 | Comer | 214/18 V |
| 2,714,472 | 8/1955 | Richardson | 214/17 CA X |
| 3,039,939 | 6/1962 | Welsh | 202/262 X |
| 3,159,290 | 12/1964 | Hesse | 214/18.2 |
| 3,682,339 | 8/1972 | Knappstein | 214/18.2 X |
| 3,693,812 | 9/1972 | Mahr et al. | 214/17 CB X |
| 3,880,720 | 4/1975 | Wagener et al. | 201/40 X |
| 3,899,088 | 8/1975 | Furuya et al. | 214/170 B X |
| 3,921,831 | 11/1975 | Takahashi et al. | 214/17 CB X |
| 3,929,240 | 12/1975 | Legille et al. | 214/35 R X |
| 3,951,750 | 4/1976 | Drebes | 201/40 X |
| 4,021,309 | 5/1977 | Radstake et al. | 202/262 X |
| 4,042,130 | 8/1977 | Legille et al. | 214/35 R |
| 4,049,141 | 9/1977 | Rohde et al. | 202/262 X |
| 4,071,166 | 1/1978 | Legille et al. | 214/35 R X |

FOREIGN PATENT DOCUMENTS

| | | | |
|---|---|---|---|
| 658956 | 3/1938 | Fed. Rep. of Germany | 202/262 |

*Primary Examiner*—Barry S. Richman

[57] ABSTRACT

Apparatus for feeding bituminous schist to a series of retorts each equipped with a rotary distribution spout and a central feed channel, the retorts radiating from a central schist distributing tower. At least one hopper communicates with a central feed channel communicating with the retort, and is laterally offset relative to the longitudinal axis of the retort. Conveyor belts are provided for conveying schists from the central distributing tower to the hopper or the hoppers of each retort.

12 Claims, 2 Drawing Figures

FEED INSTALLATION FOR APPARATUS FOR EXTRACTING HYDROCARBONS FROM BITUMINOUS SCHISTS

The present invention relates to a feed installation for apparatus for extracting hydrocarbons from bituminous schists.

It is well known that schist, which is a rock of laminated structure and comparatively brittle, contains relatively large quantities of mineral oils, varying according to the region of origin. Numerous types of apparatus have already been proposed for the extraction of these mineral oils in order to obtain hydrocarbons. In particular, this extraction can be performed by pyrolysis and distillation of thin slabs of schist in a furnace or retort, in order to cause these hydrocarbons to volatilize. Hitherto, however, this extraction process has only been adopted to a very limited extent, owing to the low percentage of mineral oil contained in the schist, which means that very considerable quantities of schistous materials have to be handled if hydrocarbon is to be produced on an industrial scale.

Owing, however, to the constant increases in the cost of hydrocarbons produced from other sources and also to the technical progress achieved in the production of hydrocarbons by the methods mentioned above, these latter are proving more and more profitable. Since, moreover, the world hydrocarbons reserves contained in bituminous schists are far greater than those contained in oil fields, the extraction of petroleum from bituminous schists is becoming increasingly important.

In a co-pending patent application entitled "Improvement in and relating to the treatment of bituminous schists" Ser. No. 822,345 filed Aug. 5, 1977, a method is suggested for the production of hydrocarbons by pyrolysis and distillation of the bituminous schist in a retort, using a feed device with a rotary distribution spout which serves to introduce the schists into the retort and of which the angle of inclination is adjustable and controlled. This device with a rotary feed spout enables the bituminous schist to be deposited in any desired manner over the entire cross section of the retort. Due to this facility the distribution of the material in the retort is completely controlled, an essential condition for optimum utilization of the schist.

To increase the economic advantage of such an installation it must be provided with a number of hydrocarbon extraction retorts, so that large quantities of schist can be treated, and also with a feed station for each of the said retorts, as a means for transporting the said large quantities with the minimum of apparatus.

As the bituminous schist fed to the extraction retorts takes the form of thin slabs which are comparatively brittle, the feed installation must be designed in such a way that they can be conveyed and handled with great care and as far as possible without falling from any height, so that the granulometry of the schist will remain homogeneous in order to ensure its even distribution in the retort and reduce the formation of dust to a minimum, as the latter not only represents a production loss but may also be carried along by the volatile substances, from which it consequently has to be reseparated.

The object of the present invention is to provide a feed installation for apparatus for extracting hydrocarbons from bituminous schists, enabling large quantities of schist to be transported and handled by relatively simple and inexpensive means and the impacts undergone by the slabs of schist to be reduced to a minimum.

To enable this object to be achieved the installation to which the present invention relates comprises a set of furnaces each equipped with a rotary distribution spout of which the angle of inclination is adjustable and controlled with a driving mechanism for the spout and with a feed channel centrally positioned at the head of the retort, above the said distribution spout, wherein the retorts are situated on each side of a central schist distributing tower, one or more hoppers communicating with the said feed channel are mounted above each retort, these hoppers being offset in respect of the longitudinal axis of the retort, and conveyor belts are provided for the purpose of conveying the schist from the central distributing tower to each of the hoppers of each retort.

In one advantageous embodiment of the invention each retort only has one single hopper. This enables the cost of the installation to be reduced and the hoppers of each retort to be positioned in relation to those of the adjacent furnace and to the "feed axis" of the hoppers in such a way as to ensure that all the conveyor belts can be positioned at the same level. The height of the installation as a whole can thus be reduced and the schist discharged from the conveyor belts into each hopper without having to fall from any height or change its direction in the course of the discharge. An installation arranged on these lines enables the thin slabs of schist to be conveyed as far as the hopper without undergoing excessive impacts.

The present invention may be better understood and its objects and advantages will become apparent to those skilled in the art by reference to the accompanying drawings of a detailed description of one embodiment of the invention and wherein.

Figure 1:
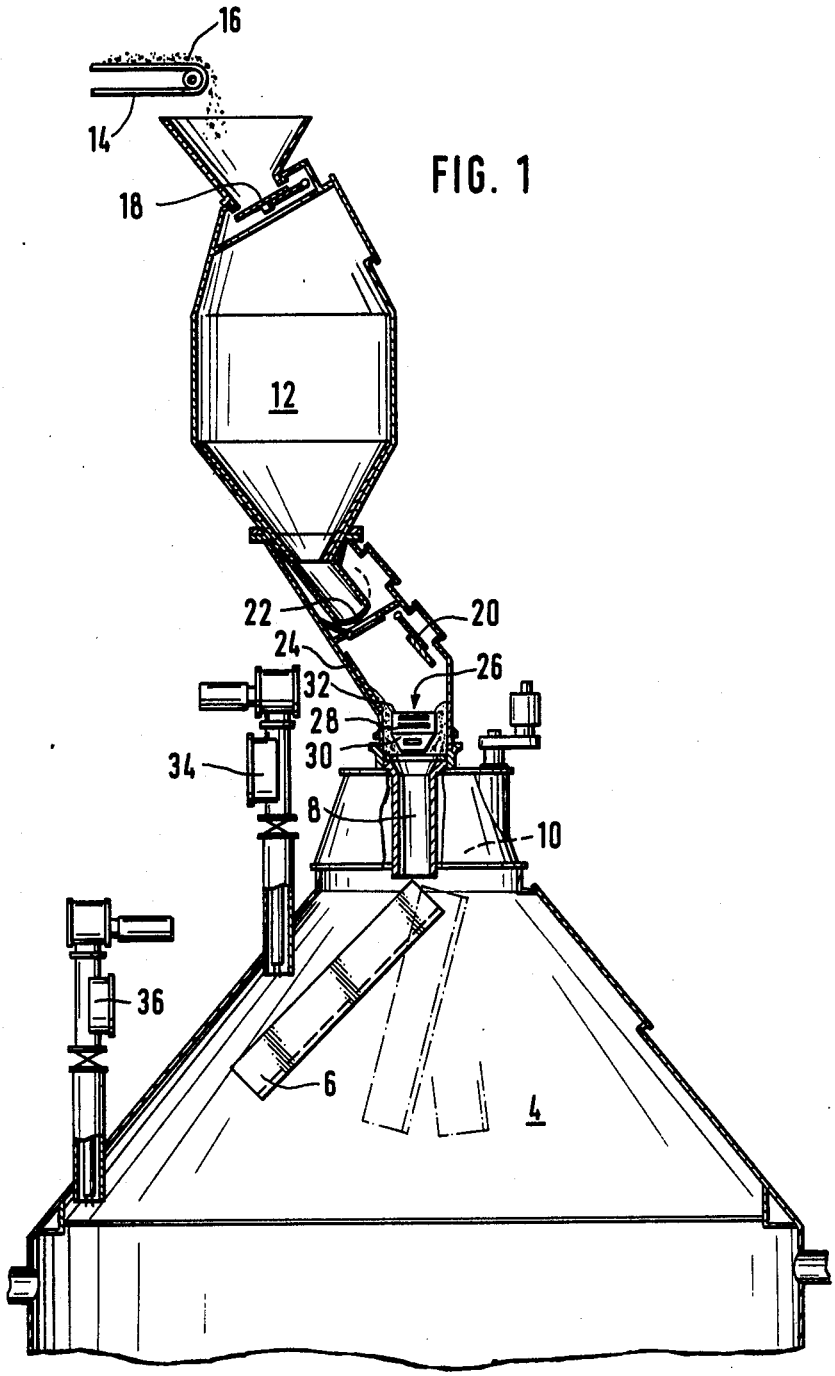
FIG. 1 is a schematic diagram of the apparatus for feeding and introducing the schist into a retort.

FIG. 1 provides a schematic diagram of the upper part of a retort 4 in which the volatile substances, particularly hydrocarbons, are extracted from the thin slabs of bituminous schist introduced into this retort. This process, which is effected by pyrolysis and distillation, is described in greater detail in the aforementioned co-pending patent application, the description of which is incorporated herein for reference and should be referred to for additional details of the said process. A rotary spout 6, with a variable and controlled angle of inclination, serves to effect a controlled and if possible, uniform distribution of the slabs of schist introduced into the retort via a central channel 8 passing through the upper part of the latter. Around this feed channel 8 is a chamber 10 containing driving devices not shown in the drawing, in order to rotate the distribution spout 6 about the longitudinal axis and regulate the angle of inclination of the spout in respect of the vertical. It may be of advantage to introduce a cooled gas into this chamber 10 in order to prevent the driving devices from heating up excessively and also in order to prevent dust from penetrating this chamber, and forming a deposit therein; this gas being circulated in the opposite direction and towards the interior of the retort. This gas circulation in the chamber 10 can be effected by recycling part of the gases which are extracted from the retort and which constitute the product of the operation. This method offers the advantage of avoiding all contamination of the production of the gases by mixture with an extraneous cooling gas. Thin slabs of bituminous schist 16 are discharged from a conveyor belt 14 into a feed hopper installed above the retort 4. This feed hopper 12 comprises an upper sealing valve 18 and a lower sealing valve 20 which are actuated alternately in such a way that the hopper 12 can function as a pressure equalizing chamber. During the filling of this hopper 12 the upper sealing valve 18 is open and the lower sealing valve 20 closed. When the hopper 12 is emptied the converse is the case, i.e. the upper sealing valve 18 is closed and the lower sealing valve 20 open. The lower sealing valve 20 serves solely to isolate the hopper 12 from the interior of the retort and not to prevent the discharge of the schist from the said hopper 12. To enable the discharge of the slabs of schist from the hopper 12 to be stopped or regulated an apportioning valve 22 is provided in the lower part of the said hopper 12. The position of this apportioning valve 22 determines the quantity of schist introduced per unit of time into the retort and thus the length of time required to discharge the contents of a hopper.

The connection between the hopper 12 and the vertical feed channel 8 is provided via a discharge channel 24 which, in accordance with one preferred embodiment of the present invention, is situated in a slanting position in relation to the vertical; in other words, the longitudinal axis of the hopper 12 is at a certain distance from the longitudinal axis of the retort and the vertical feed channel 8. At the intersection of the vertical feed channel 8 and the oblique discharge channel 24 a tubular plug 26 is provided, comprising an upper cylindrical part 28 for example, formed of a pile of separate rings, which vertically penetrates the discharge channel 24 and a lower part 30, for preference of the shape of a truncated cone, which penetrates the vertical feed channel 8. This tubular plug 26 serves to slow up the discharge of the thin slabs of schist coming from the hopper 12 and to establish a barrier of schist slabs 32 around the cylindrical part 28. A first function of this tubular plug 26 is to slow up the descent of the slabs of schist and prevent them from making violent impact on the side walls of the feed channel 8. This measure fulfils the requirement expressed farther back to the effect that the slabs of schist must be handled with care. A second function of this tubular plug 26 is to guide the fall of the slabs of schist along the central axis of the channel 8 onto the distribution spout 6, in order to prevent any uneven distribution which might result from their uncontrolled and irregular fall through this feed channel 8. The free fall of the schist is thus effected from the upper edge of the tubular plug 26 and not from the feed hopper 12.

The arrangement adopted for the various components, as shown in the drawing, thus ensures a vertical central descent on the distribution spout 6, reducing to a minimum the distance over which the material falls freely. The fact is that a major of the descent of the schist from the hopper 12 to the upper layer in the retort 4 is effected by a sliding movement, first of all in the slanting discharge channel 24 and subsequently in the distribution spout 6. The schist is therefore deposited in the place at which the spout is aimed without undergoing any appreciable impacts during the feed operation.

FIG. 1 shows, by way of an example, two vertical probes 34 and 36 serving to determine the charging level in the furnace 4. It is possible to provide a number of these probes, evenly distributed around the feed apparatus in the upper part of the furnace 4, with the possible addition of ecentral probe, not shown in the drawing, which effects the probing operation through the vertical feed channel and along the spout when the latter occupies the vertical position. These probes may be of the type known per se, e.g. of the mechanical type or of the kind which operates by radiation. These probes make it possible to detect any unevenness in the upper surface of the contents of a furnace, so that this irregularity can be corrected by the distribution with the spout 6, or to detect any collapse of the pile of material in the furnace 4, so that the charging operation can be initiated for the purpose of restoring the desired level. If mechanical probes are used they can naturally be removed during the charging operation, in order not to impede the rotation of the distribution spout 6. The data supplied by the vertical probes can be stored for eventual use for the automated control of the charging process.

Means are provided, not shown in the drawing, for continuously determining the weight of the hopper 12 and also of its contents. These means may consist, for example, of three electrostatic transductors on which the hopper rests. Transductors of this kind provide continuous electrical signals proportional to the weight of the hopper or, in the case of suitable calibration, to the weight of its contents. The measuring signals supplied by the operation of weighing the contents of the hopper 12 may be used for the automatic control of the distribution spout 6. The weighing signals can also be used while the hopper is being filled, in order to stop the conveyor belt 14 automatically when the contents of the hopper reach the desired weight. If, for example, the spout is programmed to deposit the schist in concentric circles, these signals can be used for the purpose of automatically changing the angular position of the spout when a certain preselected quantity of schist has been deposited. Any such automatic charging process, of course, must take due account of various parameters, such as the speed at which the schist is discharged from the hopper 12, i.e. the extent to which the apportioning valve 22 is open, the granulometry of the schist, the rotation speed of the spout etc. It is of advantage to adjust these various parameters in such a way that the contents of the hopper 12 will be deposited in a complete layer, either in concentric circles or in spiral configuration, the charging operation being commenced at the periphery of the furnace and the final part of the layer being deposited in the centre.

The volumetric capacity of the feed hopper 12 must be adapted to that of the furnace 4. No particular requirements are laid down regarding its shape. Instead of installing the hopper 12 vertically, as shown in FIG. 1, it can be slightly inclined in the direction of the conveyor belt 14, so that the thin slabs of schist 14 will slide in the hopper 12, again for the purpose of avoiding jolts or impacts.

Each furnace can be provided with a number of different feed hoppers. For furnace 4, for example, a second hopper can be positioned symmetrically in respect of the hopper 12 and in respect of the longitudinal axis of the furnace.

The conveyor belt 14 could then be prolonged so that it terminated between the two hoppers. In this case it would be sufficient to provide a baffle to deflect the flow of schist into one or other of the two hoppers. If two hoppers are used, one of them can be charged while the other is being evacuated.

Figure 2:
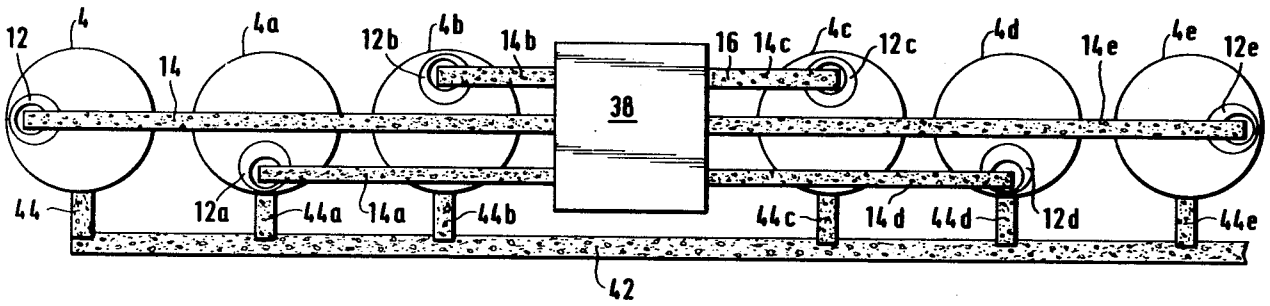
FIG. 2 is a schematic diagram of a complete installation with a number of retorts and with a central schist distribution tower.

FIG. 2 shows a complete installation comprising a set of furnaces arranged preferably in a straight line on both sides of a central schist distribution tower 38. The example shown comprises three furnaces 4, 4a and 4b situated on one side of the tower 38 and three furnaces 4c, 4d and 4e situated on the other side of the said tower 38. All these furnaces are identically similar to one another and also to the furnace 4 shown in FIG. 1. These furnaces, 4, 4a, 4b, 4c, 4d and 4e thus comprise hoppers 12, 12a, 12b, 12c, 12d and 12e which are served by conveyor belts 14, 14a, 14b, 14c, 14d and 14e. All these conveyor belts start from the central distribution tower 38 in which they are fed with the slabs of schist 16 in order to discharge them into the corresponding hoppers of each of the furnaces. The treated schist which is released at the lower part of each of these furnaces, drops onto the conveyor belts 44, 44a, 44b, 44c, 44d and 44e, which evacuate the treated schist onto a high-capacity common conveyor belt 42, by which the processed schist is evacuated from the complete installation.

The arrangement of the furnaces, as described above and shown in FIG. 2, enables a large number of furnaces to be served by one single central schist distribution tower. The number of furnaces on each side of the tower 38 is obviously not limited to three, and a larger number of furnaces could easily be provided. It would even be possible to provide two supplementary sets of furnaces, situated in a straight line on each side of the tower 38, perpendicularly to the alignment of the furnaces shown in FIG. 2, the complete group of furnaces then forming a cross.

A preferred embodiment of the invention provides for the arrangement of the furnaces in a straight line. The fact is that this facilitates the transport of the bituminous schist from the tower to each of the furnaces and also the evacuation of the treated schist by means of conveyor belts. A further feature of the arrangement covered by the present invention resides in the fact that the different furnaces, although identically similar to one another and although aligned, each face a different way in relation to the adjacent furnace, so that the position of a hopper of a furnace on one side of the tower corresponds to the position of the hopper of the corresponding furnace on the other side of the tower 38, as shown in FIG. 2. This enables one conveyor belt to be associated with each furnace and all the conveyor belts to be positioned at the same level, i.e. the lowest possible level enabling the material to be fed to the hoppers. This method enables the total height of the installation and also the number of falling points for the slabs of schist to be reduced. The fact is that if the hoppers were aligned with one another it would be necessary either to position the conveyor belts one above the other, which would not only increase the total height of the installation but also the height of fall and therefore the impacts undergone by the slabs of schist, or to provide one main conveyor belt and a set of secondary conveyor belts positioned perpendicularly in relation to the main conveyor belt, in order to deflect the material from the said secondary conveyor belts into each of the furnaces, in a similar manner to that in which the treated schists shown in FIG. 2 are evacuated. This solution, however, suffers from the drawback of entailing higher expenditure, particularly on the erection and drive of the secondary conveyor belts, in addition to resulting in a further falling point for the schist between the main belt and the secondary belt, the slabs of schist being thereby subjected to more jolts and impacts.

It may therefore be seen that the means adopted in the present invention for the distribution of slabs of schist to the various furnances are reduced to a minimum but nevertheless enable large quantities of this material to be transported and handled. Thanks to the provision of the conveyor belts and the elimination or reduction of a certain number of falling points in the changes of direction occurring in the transport of the bituminous schist, the jolts and impacts to which the latter is subjected are likewise reduced, resulting in the preservation of an even granulometry and in reduced emission of dust.

What we claim is:

1. A feed system for apparatus for extracting hydrocarbons from the bituminous schists comprising a plurality of retorts in linear array radially of a schist distributing tower, each of said retorts having a rotary distribution spout of which the angle of inclination is adjustable and controlled, means for rotating said spout, a feed channel centrally positioned at the top of each said retort and discharging at its lower end into said distribution spout, at least one hopper communicating with said feed channel via an inclined discharge channel and mounted above each said retort and being offset in respect of the vertical axis of the retort, means coacting between and within said feed channel and said inclined discharge channel at the intersection thereof for slowing up the descent of schist from said hopper into said retort and including an upper portion extending into said inclined discharge channel vertically and a lower portion extending into the feed channel vertically, and a plurality of individual conveyors each communicating between the central distributing tower and the said at least one offset hopper of each retort to transport said schists from said central distributing tower to said retorts, and conveyor means coacting with the lower end of each of said retorts for removal of spent schists.

2. A feed system in accordance with claim 1 wherein each retort is provided with a single hopper which is offset in relation to the vertical axis of said retort.

3. A feed system in accordance with claim 1 wherein each hopper communicates with the central feed channel via a dischage channel which is inclined in respect of the vertical axis of said retort.

4. A feed system in accordance with claim 1 wherein each hopper is designed as a sealing chamber and comprises an upper sealing valve and a lower sealing valve.

5. A feed system in accordance with claim 1 comprising an apportioning valve positioned between each hopper and the central feed channel and serving to control the rate of delivery at which the material is discharged from the hopper associated therewith.

6. A feed system in accordance with claim 1 comprising at least one probe positioned in the upper end of the retort for sensing the upper level of the contents of the retort and any irregularities in said level.

7. A feed system in accordance with claim 1 wherein the hoppers of a set of retorts situated on one side of the central distribution tower are offset in relation to one another and in respect of the axis along which the retorts are aligned.

8. A feed system in accordance with claim 1 wherein all of the conveyors commmunicating between the central distribution tower and the hoppers of the retorts are situated at the same height.

9. A feed system for apparatus for extracting hydrocarbons from bituminous schists comprising a plurality of retorts in linear array radially of a central schist distributing tower, each of said retorts having a rotary distribution spout of which the angle of inclination is adjustable and controlled, means for rotating said spout, a feed channel centrally positioned at the top of each said retort and discharging at its lower end into said distribution spout, at least one hopper communicating with said feed channel via an inclined discharge channel and mounted above each said retort and being offset in respect of the vertical axis of the retort, a tubular plug of circular cross section located at the intersection of the inclined discharge channel and the central feed channel, said plug comprising a cylindrical upper portion extending into the inclined discharge channel vertically and a lower portion having the shape of a truncated cone extending into the feed channel vertically, and conveyor belts each communicating between the central distributing tower and the said at least one offset hopper for conveying the schists from the central distributing tower to each of the hoppers of each retort.

10. A feed system in accordance with claim 9 wherein the cylindrical portion of the tubular plug consists of a pile of separate rings.

11. A feed system in accordance with claim 9 wherein each retort has a conveyor belt associated with it for conveying the schist from the central distribution tower to the hopper of said retort.

12. A feed system in accordance with claim 11 wherein each hopper of each retort has a single conveyor belt communicating between said central distribution tower and said hopper.

* * * * *